United States Patent [19]

Sayo et al.

[11] 4,188,783

[45] Feb. 19, 1980

[54] EXHAUST GAS PURIFICATION DEVICE

[75] Inventors: Shigemasa Sayo; Yasuyuki Sugiura, both of Hamamatsu; Katutoshi Ueda, Iwata; Hirohiko Fujiwara, Hamamatsu; Toshikatsu Hibi, Hamana, all of Japan

[73] Assignee: Suzuki Jidosha Kogyo Kabushiki Kaisha, Hamana, Japan

[21] Appl. No.: 823,443

[22] Filed: Aug. 10, 1977

[51] Int. Cl.[2] ..... F01N 3/15

[52] U.S. Cl. ..... 60/277; 60/290; 60/299; 60/302; 60/322

[58] Field of Search ..... 23/288 FC; 60/299, 302, 60/277, 290, 322

[56] References Cited

U.S. PATENT DOCUMENTS

| | | | |
|---|---|---|---|
| 3,773,894 | 11/1973 | Bernstein | 23/288 FC |
| 3,854,888 | 12/1974 | Frietzsche | 23/288 FC |
| 3,934,411 | 1/1976 | Masaki | 60/282 |
| 3,935,705 | 2/1976 | Hergoualch | 60/302 |
| 3,957,445 | 5/1976 | Foster | 23/288 FC |
| 3,963,445 | 6/1976 | Koyama | 23/288 FC |
| 3,964,259 | 6/1976 | Fitzgerald | 60/290 |
| 3,983,283 | 9/1976 | Bagley | 23/288 FC |

*Primary Examiner*—Douglas Hart

*Attorney, Agent, or Firm*—Fitzpatrick, Cella, Harper & Scinto

[57] ABSTRACT

The exhaust gas purification device includes an exhaust manifold, a purification cylinder connected with the exhaust manifold through a first honey-comb shaped catalyst, and a second honey-comb shaped catalyst positioned at the rear portion of the purification cylinder. Each catalyst is supported by steel wool rings including coarse and dense portions of steel wool. The purification device further includes a secondary air supplying arrangement.

3 Claims, 5 Drawing Figures

EXHAUST GAS PURIFICATION DEVICE

BACKGROUND OF THE INVENTION

This invention relates to an exhaust gas purification device adapted for use in a two-cycle internal combustion engine.

The exhaust gas from an engine contains some harmful components such as carbon monoxide, hydrocarbons, nitrogen oxide, and the like. In comparison of a four-cycle engine with a two-cycle engine, it is well known that in the former combustion gases are effectively exchanged to fresh air thereby raising combustion temperature, so that the exhaust gas contains a large quantity of nitrogen oxide and a small quantity of hydrocarbons, but in the latter, combustion gases are insufficiently exchanged to fresh air and the combustion temperature is low due, for example, to charge-loss gas, so that the exhaust gas contains a large quantity of hydrogen, a small quantity of nitrogen oxide and substantially equal quantity of carbon monoxide to that in the four-cycle engine.

Bearing the above fact in mind, it is necessary to effectively purify the exhaust gas from the two-cycle engine without lowering the performance of the engine.

SUMMARY OF THE INVENTION

Accordingly, an object of this invention is to provide an exhaust gas purification device for a two-cycle engine having improved construction for purifying effectively the exhaust gas.

According to this invention there is provided an exhaust gas purification device for use in a two-cycle internal combustion engine of the type including an exhaust manifold, a purification cylinder connected with the exhaust manifold through a first honey-comb catalyst, a second honey-comb catalyst positioned at the rear portion of the purification cylinder, and a muffler connected with the purification cylinder on the downstream side of the second catalyst, and in the improvement of the device, the first and second catalysts are supported by steel wool rings, each of the rings comprising coarse and dense portions of steel wool.

BRIEF DESCRIPTION OF THE DRAWINGS

The other objects and advantages of the present invention will be more readily understood from the following description of a preferred embodiment of the invention taken in conjunction with the accompanying drawings, in which.

DETAILED DESCRIPTION OF THE PREFERRED EMBODIMENT

Figure 1:
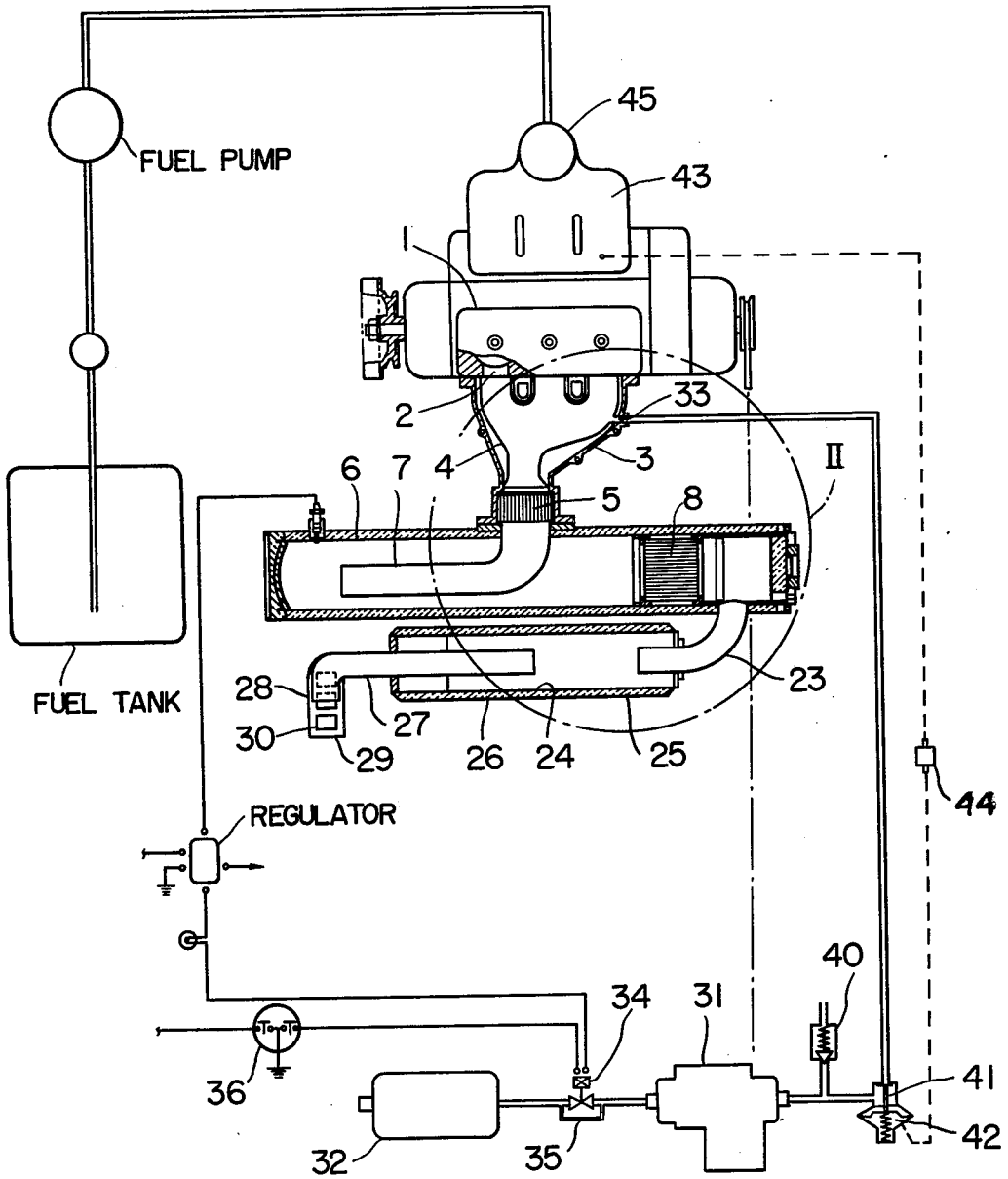
FIG. 1 is a diagrammatic represention, partly in section, showing a purification device according to this invention.
Figure 2:
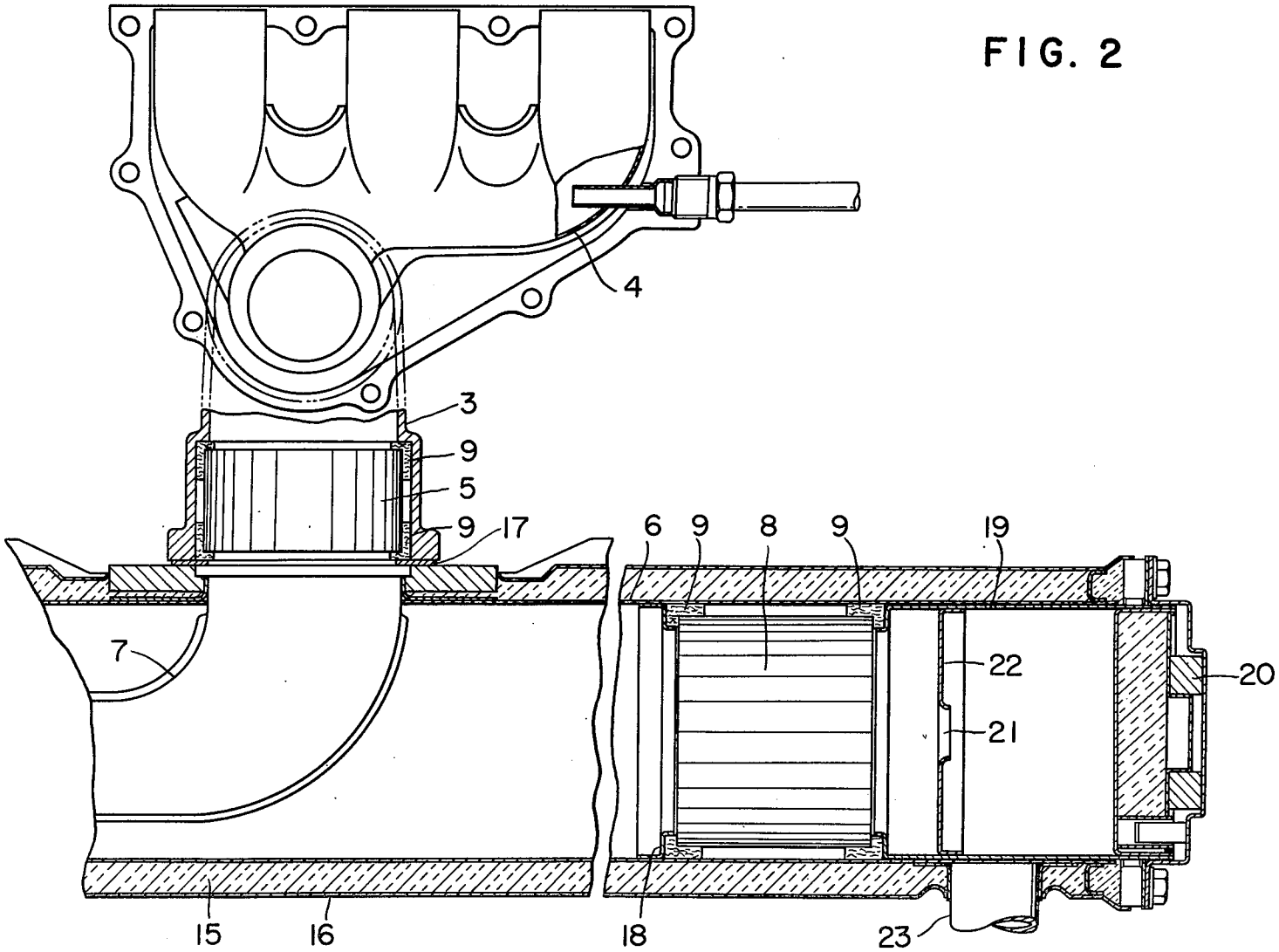
FIG. 2 is an enlarged sectional view of the portion II encircled in FIG. 1.

Referring to FIG. 1, a split type exhaust manifold 3 made of cast iron is fitted firmly to an exhaust port 2 of a two-cycle internal combustion engine 1, and an inner pipe 4 made of stainless steel is provided inside the exhaust manifold 3 with some space therebetween. This inner pipe 4 is made of heat-resistant and less heat-conductive material so as not to lower the temperature of the exhaust gas. In the outlet portion of the exhaust manifold there is fitted a first catalyst 5 which is made of honey-comb shaped ceramic coated with a catalytic agent and is attached to the manifold 3 by interposing steel wool rings 9 therebetween as shown in FIG. 2. The outlet end of the manifold 3 is connected with an intermediate portion of the cylindrical wall of a purification cylinder 6 and communicated therewith through a crooked take-in pipe 7. The exhaust end of the take-in pipe 7 is directed to the front end (leftward end as viewed in FIG. 1) of the purification cylinder 6, and in the rear portion (rightward portion as viewed in FIG. 1) of the cylinder 6 there is fitted a second honey-comb shaped catalyst 8 which has substantially the same construction as the first catalyst 5. The reason that the pipe 7 is directed in a direction opposite to the second catalyst is to increase the path of gas flow for cooling the gas thereby increasing the effeciency of the second catalyst 8.

As shown in FIG. 2, a partition plate 22 provided with a hole is positioned behind the second catalyst 8 and the portion behind the partition plate 22 is communicated with a muffler 24 through a connecting pipe 23.

As shown in FIG. 2, the first and second honey-comb catalysts 5 and 8 are supported by the rings 9 made of steel wool so as not to be crushed by external vibration, and the durability of the first catalyst 5 is improved by interposing a flexible gasket 17 made of steel wool between the outlet end of the exhaust manifold 3 and the purification cylinder 6. These catalysts enable the exhaust gas to pass easily there-through and reduce the back pressure to prevent the lowering of the performance of the engine in comparison with a conventional pellet-type catalyst. Each of rings 9 applied to the second catalyst 8 consists of a coarse portion 10 and a dense portion 11 of steel wool (FIG. 3*b*), and the former acts as a cushion and the latter as a seal.

Figure 3A:
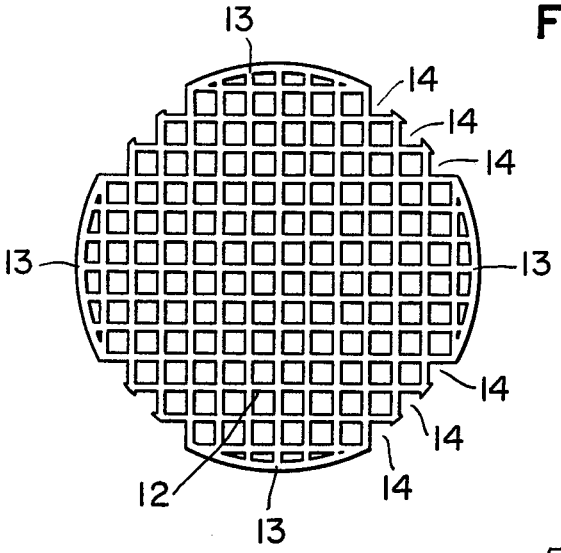
FIG. 3*a* is a front view of a honey-comb catalyst constructed according to this invention.
Figure 3B:
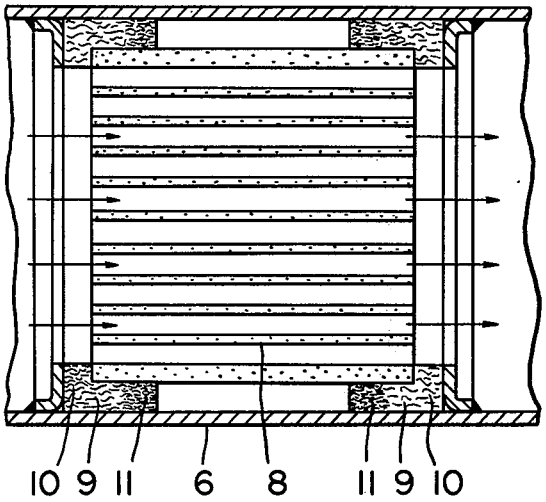
FIG. 3*b* is a side view of the honey-comb catalyst supported by specifically formed steel wool rings.

As shown in FIG. 3*a*, a ceramic carrier 12 is provided with an outer shell 13 on the peripheral surface to reinforce the carrier 12 and several notches 14 are provided to the shell 13 to resist the thermal strain of the shell 13 due to the high temperature of the exhaust gas.

As shown in detail in FIG. 2, the purification cylinder 6 is surrounded by an outer sleeve 16 and a heat insulating material 15 is filled therebetween to prevent heat radiation from the cylinder 6 because the cylinder is considerably heated due to the exothermic oxidation reaction of the first catalyst 5 and such high temperature is required for the oxidation reaction of the second catalyst 8.

The take-in pipe 7 is welded to the outer sleeve 16 and the purification cylinder 6 at the central portion of the cylinderical walls, and since the cylinder 6 is merely inserted into the sleeve 16 and the cylinder and the sleeve are fixed and held with each other only at the welded portion, both ends of the cylinder 6 can freely expand when heated. Thus the heat break-down of the cylinder 6 can be prevented.

The second catalyst 8 is inserted through the rear end of the purification cylinder 6 and abuts against a stop ring 18 attached to the inside wall of the cylinder 6 through the ring 9 and a push cylinder 19 is further inserted into the cylinder 6 to force the catalyst 8 to the stop ring 18 through the ring 9. Spring means 20 is fitted to the rear end of the push cylinder 19 thereby urging the catalyst 8 against the stop ring 18 with a predetermined pressure and prevents it from being moved by the heat expansion. Thus, the vibration and the break-down of the second catalyst 8 can be prevented and the durability thereof can also be improved.

The partition plate 22 provided with a hole 21 is welded to the inside wall of the push cylinder 19 and acts as silencing means. Near the rear end of the purification cylinder 6 a connecting pipe 23 connected to the muffler 24 is welded to the outer sleeve 16. The muffler 24 is surrounded by an outer sleeve 25 and heat insulating material 26 is filled there-between to prevent heat radiation. The inside of the muffler 24 is the same in itself as a conventional one and constitutes a silencing chamber. An exhaust pipe 27 is located inside the muffler 24 and the exhaust end thereof passes through the downstream end of the muffler 24 and connected with a diffuser pipe 28. The diffuser pipe 28 is provided with slits 30 to cool the exhaust gas by air sucked therethrough and a discharge opening 29.

In order to effectively purify the exhaust gas by contacting it with the catalyst and promote the oxidation reaction, it is necessary to supply a suitable quantity of secondary air to supplement oxygen.

The secondary air supplying means according to this invention is described hereunder.

The secondary air is supplied by a plunger-type air pump 31 interconnected with the engine 1 in a manner that when the engine 1 is driven, the air pump 31 is operated and air sucked from an air cleaner 32 is supplied to the inside of the inner pipe 4 through a secondary air nozzle 33 passing through the walls of the exhaust manifold 3 and the inner pipe 4, and the secondary air is mixed suitably with the exhaust gas in the inner pipe 4.

Figure 4:
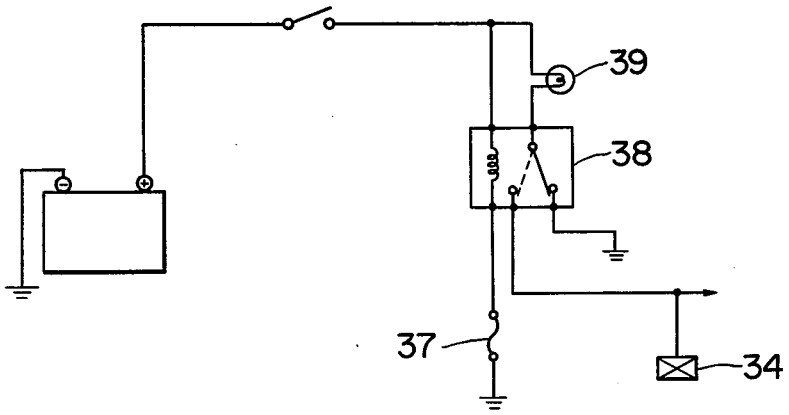
FIG. 4 is a diagramatic view of abnormal temperature alarming means for the exhaust gas purification device shown in FIG. 1.

An electromagnetic valve 34 and a fine bypass pipe 35 bypassing the valve 34 are located between the air pump 31 and the air cleaner 32, and the electromagnetic valve 34 is connected with a thermal switch 36. As shown in FIG. 4 a fusible thermal sensor 37 is provided for the purification cylinder 6 and connected to an alarm lamp 39 through a relay 38, whereby if the purification cylinder 6 is heated excessively, the thermal sensor 37 is fused to light the alarm lamp 39 through the relay 38.

Between the air pump 31 and the secondary air nozzle 33 are provided a safety valve 40 and a switch valve 41 responsive to a negative pressure, and a booster 42 of the valve 41 is connected through an orifice 44 with a suction pipe 43 of the engine 1 to alleviate the operation of the valve 41.

The exhaust gas purification device for a two-cycle engine according to the present invention operates as follows:

The exhaust gas from the two-cycle engine 1 flows towards the first honey-comb catalyst 5 through the inner pipe 4 without substantially lowering the temperature of the exhaust gas, whereby the exothermic oxidation reaction is done with the first catalyst. The exhaust gas heated by the reaction is then guided to the crooked take-in pipe 7 located inside the purification cylinder 6, blasted towards the closed front end of the cylinder (leftwardly as viewed in FIG. 1) and then reversed rearward. The reversed gas at high temperature is again oxidized by the second honey-comb catalyst 8 to further purify the exhaust gas.

It is required for the second catalyst to prevent the gas from leaking through the rings 9 for complete purification, so that as mentioned before, the rings 9 supporting the catalyst comprise the coarse portion 10 and the dense portion 11 of steel wool.

The exhaust gas passing through the second catalyst collides against the partition plate 22 which acts as a first silencer, and then passes through the hole 21 to the muffler 24 and finally to the diffuser 28, where the exhaust gas is finally cooled by the air taken through the slits 30 thereby preventing high temperature gas from being exhausted.

In order to facilitate the oxidation reaction of the exhaust gas with the catalysts, secondary air is supplied to the inner pipe 4, and this operation is achieved as follows:

The electromagnetic valve 34 is closed while the engine 1 is warmed up, and during this interval air is supplied only through the fine bypass pipe 35 to restrict the secondary air supply, to control cooling of the exhaust gas, to easily warm up the inner pipe 4 and the purification cylinder 6 and to shorten the time from the starting of the engine 1 to the time when the purification becomes effective. After the warming up of the engine, the thermal switch is closed and the electromagnetic valve 34 is opened thereby supplying the secondary air in a quantity required for the purification.

When a throttle valve provided for a carbureter 45 is opened substantially fully for obtaining high power output of the engine 1, the negative pressure in the suction pipe 43 is reduced and the negative pressure switch valve 41 is closed. Thus, the supply of the secondary air is stopped and the overheat of the purification cylinder 6 at the large power output can be prevented. While the engine 1 is driven at a medium or low power, the negative pressure increases and the switch valve 41 is opened fully thereby supplying sufficient amount of the secondary air.

Since the negative pressure in the suction pipe 43 is transmitted to the switch valve 41 through the orifice 44, the operation of the switch valve is alleviated, and therefore, the valve 41 is closed only in the case of maintaining the highpower output, but it is not operated when the throttle valve of the carbureter 45 is alternately closed and opened repeatedly in a short time.

The exhaust gas purification device for a two-cycle engine according to the present invention utilizes two-stage honey-comb catalysts to effectively purify the exhaust gas containing a large quantity of hydrocarbons and since the catalysts are prepared by applying a catalytic agent on the ceramic, the back pressure and the power down of the engine are made considerably lower than conventional pellet-type catalyst. The catalysts are also constructed to resist against the external vibration and thermal strain. Furthermore, the heat resistant and less heat conductive inner pipe 4 is provided within the exhaust manifold so that the cooling of the exhaust gas can be prevented. The secondary air supply is suitably controlled to effectively perform the purification and can be stopped under a high load condition of the engine for safeness.

Further it is to be understood by those skilled in the art that the foregoing description refers to a preferred embodiment of this invention and that various modifications and changes may be made without departing from the scope and spirit of the invention as defined in the appended claims.

We claim:

1. In an exhaust gas purification device for use in an internal combustion engine of the type including an exhaust manifold, a purification cylinder connected with said exhaust manifold, a first honey comb catalyst, a second honey comb catalyst positioned at a downstream portion of said purification cylinder, and a muffler connected with said purification cylinder on the downstream side of said second catalyst; an improvement wherein both of said first and second catalysts consist of oxidation catalyst, the first and second honey comb catalysts being separated and respectively provided at the exit portion of the exhaust manifold and at the inner portion of the purification cylinder, a secondary air inlet being provided at an upstream portion of the first honey comb catalyst, said first and second honey comb catalysts are respectively supported by steel wool rings, each of said rings comprising a coarse portion adapted for cushion and a dense portion adapted for sealing, and an intake pipe is provided at the central portion of the cylindrical wall of said purification cylinder, said purification cylinder being surrounded by an outer sleeve so that both ends of said cylinder can expand freely and axially when heated, said outer sleeve being fitted with a heat insulating layer.

2. In an exhaust gas purification device for use in an internal combustion engine of the type including an exhaust manifold, a purification cylinder connected with said exhaust manifold, said exhaust manifold being provided with an inner pipe and a nozzle for supplying secondary air into said inner pipe, said secondary air being supplied by an air pump interlocked with the engine, and an electromagnetic valve located on the inlet side of said air pump and being opened in response to cooling water at a predetermined temperature and closed in response to abnormal temperature of said purification cylinder, a first honey comb catalyst, a second honey comb catalyst positioned at a downstream portion of said purification cylinder, and a muffler connected with said purification cylinder on the downstream side of said second catalyst, both of said first and second catalysts consisting of oxidation catalyst, the first and second honey comb catalysts being separated and respectively provided at the exit portion of the exhaust manifold and at the inner portion of the purification cylinder, and said first and second honey comb catalysts being respectively supported by steel wool rings, each of said rings comprising a coarse portion adapted for cushion and a dense portion adapted for sealing.

3. The exhaust gas purification device according to claim 1, wherein a gasket composed of steel wool is interposed between said exhaust manifold and said take-in pipe of the purification cylinder.

* * * * *